US006068118A

United States Patent [19]

Calloway

[11] Patent Number: 6,068,118

[45] Date of Patent: May 30, 2000

[54] PORTABLE TOILET PAPER CADDY

[76] Inventor: Ruby Jewell Calloway, 765 21st. St., Richond, Calif. 94801

[21] Appl. No.: 09/398,853

[22] Filed: Sep. 17, 1999

[51] Int. Cl.[7] ..... B65D 85/671; A45C 15/06

[52] U.S. Cl. ..... 206/233; 362/156

[58] Field of Search ..... 206/225, 233, 206/581, 216, 390; 242/156, 422, 565; 362/154, 156, 253

[56] References Cited

U.S. PATENT DOCUMENTS

| | | | |
|---|---|---|---|
| 4,279,342 | 7/1981 | Van Pelt | 206/542 |
| 4,280,643 | 7/1981 | Cordova et al. | 206/225 |
| 4,571,740 | 2/1986 | Kirby et al. | 206/216 |
| 5,090,063 | 2/1992 | Edwards et al. | 206/225 |
| 5,143,440 | 9/1992 | Trampota | 362/156 |
| 5,273,227 | 12/1993 | Smith, Jr. | 242/156 |
| 5,624,025 | 4/1997 | Hixon | 206/233 |
| 5,685,421 | 11/1997 | Gilmore | 362/156 |
| 5,758,843 | 6/1998 | Ongaro | 242/565 |
| 5,762,285 | 6/1998 | Lin | 242/565 |

*Primary Examiner*—Jim Foster
*Attorney, Agent, or Firm*—Goldstein & Canino

[57] ABSTRACT

A toilet paper caddy, for storing, transporting, and dispensing toilet paper from standard toilet paper rolls having a continuous length of toilet paper divided into sheets that are separated by perforations, comprising a main housing having a top and a bottom, wherein a front panel is hingeably connected to the bottom. A toilet paper dispenser is located within the main housing, for dispensing toilet paper from the toilet paper roll. The dispenser has a limiting device for limiting the amount of toilet paper dispensed with each pull. A flashlight is provided within the main housing, which is usable in conjunction with the main housing, or may be detached for independent use therefrom. A radio having radio controls and a clock having a clock face are also provided and situated wherein the clock face and radio controls are usable through the front panel.

3 Claims, 2 Drawing Sheets

PORTABLE TOILET PAPER CADDY

BACKGROUND OF THE INVENTION

The invention relates to a portable toilet paper caddy. More particularly, the invention relates to a portable housing for storing, transporting, and dispensing toilet paper, and for storing and transporting a variety of survival and convenience items.

Although toilet paper is one of the greatest necessities of our day-to-day lives, it is often neglected or forgotten when engaging in activities such as hiking or camping. Even when it is not forgotten, the toilet paper roll can easily become wet and dirty long before it is even used. When toilet paper is carelessly packed along with other belongings, a great potential for the transmission of bacteria, germs, and disease exists.

Even when housed in a dispenser of sorts, a further problem exists in that too much toilet paper has a tendency to unwind. As a user attempts to tear the toilet paper, and often as the paper is initially unwound, the paper fails to tear and/or tends to continue unwinding past a desirable location. As is often the case with toilet paper, the toilet paper unwinds to a point where it covers a portion of the ground. Even if the floor is considered relatively clean, and the user wishes to rewind the toilet paper onto the roll, most attempts at manually rewinding toilet paper rolls produce unsightly results.

U.S. Pat. No. 4,595,154 to Swope discloses a portable roll dispenser, which is capable of filling with water to act as a ballast to make the dispenser free standing. However, the majority of the roll is left exposed, and thus the dispenser does little to prevent the toilet paper from becoming prematurely soiled.

U.S. Pat. No. 5,273,227 to Smith, Jr. discloses a rotation retarded product roll, wherein the over-dispensing of toilet paper or other rolled paper products is sought to be prevented. However, Smith discloses a device which is suited for wall mounting, and makes no attempts at providing a solution to the need for toilet paper portability.

While these units may be suitable for the particular purpose employed, or for general use, they would not be as suitable for the purposes of the present invention as disclosed hereafter.

SUMMARY OF THE INVENTION

It is an object of the invention to produce a portable toilet paper caddy which effectively protects toilet paper during storage and transportation thereof, and yet allows said toilet paper to be easily and conveniently dispensed when needed. Accordingly, a housing is provided which fully encases the toilet paper. An access panel may be opened to provide access to the toilet paper when dispensing thereof is desired.

It is another object of the invention to provide a portable toilet paper caddy which provides a variety of convenience, safety, and survival features integral therewith. Accordingly, a radio, clock, and flashlight are provided with convenient access, regardless of whether the access panel is opened or closed.

It is a further object of the invention that the flashlight may be used in conjunction with the caddy housing, or may be detached therefrom. Accordingly, with the access panel closed, an aperture allows the flashlight beam to illuminate the area in the vicinity of the caddy housing. With the access panel in the open position, the flashlight can be fully detached therefrom for fully independent use.

The invention is a toilet paper caddy, for storing, transporting, and dispensing toilet paper from standard toilet paper rolls having a continuous length of toilet paper divided into sheets that are separated by perforations, comprising a main housing having a top and a bottom, wherein a front panel is hingeably connected to the bottom. A toilet paper dispenser is located within the main housing, for dispensing toilet paper from the toilet paper roll. The dispenser has a limiting device for limiting the amount of toilet paper dispensed with each pull. A flashlight is provided within the main housing, which is usable in conjunction with the main housing, or may be detached for independent use therefrom. A radio having radio controls and a clock having a clock face are also provided and situated wherein the clock face and radio controls are usable through the front panel.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
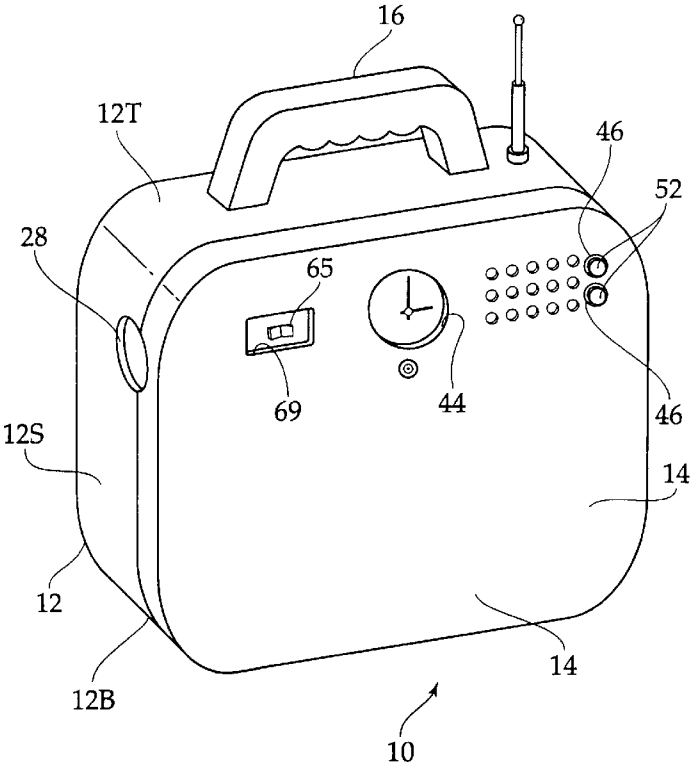
FIG. 1 is a diagrammatic perspective view, illustrating the toilet paper caddy-with the access panel closed.

FIG. 1 illustrates a toilet paper caddy 10, comprising a main housing 12, having a top 12T, a bottom 12B, a side 12S, and a front panel 14. The front panel 14 is hingeably attached to the main housing 12 at the bottom 12B, but is shown in a closed position in FIG. 1. A handle 16 is mounted at the top 12T to allow for convenient manual carrying of the caddy 10.

Figure 2:
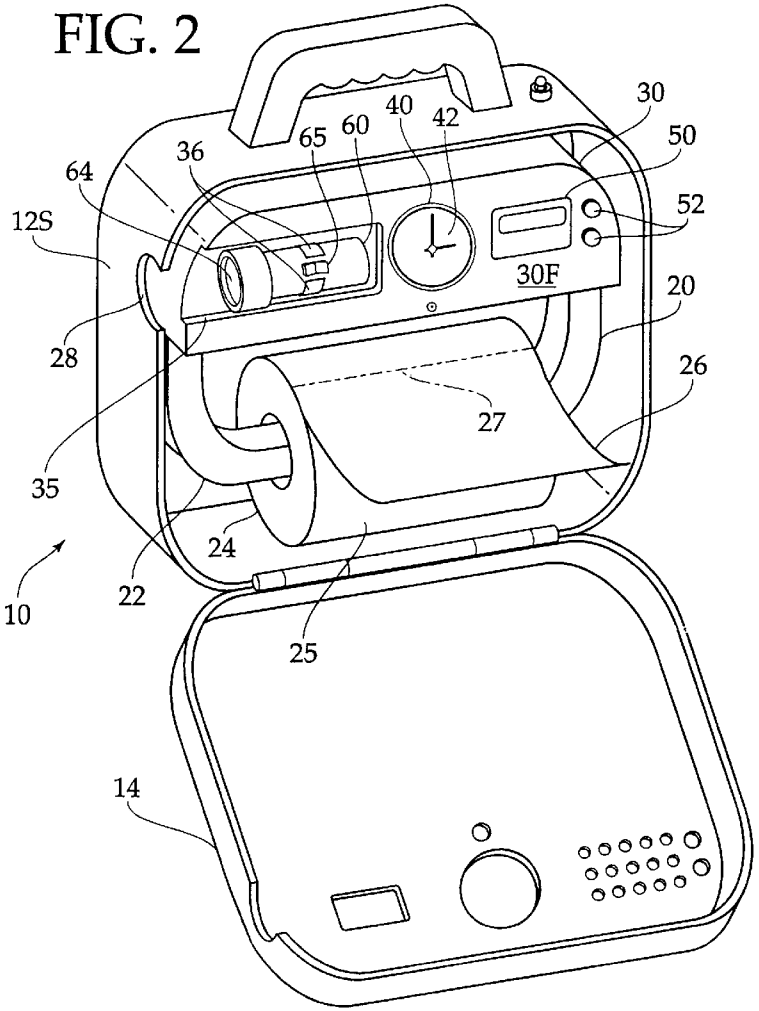
FIG. 2 a diagrammatic perspective view, illustrating the toilet paper caddy wherein the access panel is opened, revealing and providing access to the toilet paper and various other accessories of the instant invention.

FIG. 2 illustrates the toilet paper caddy 10, wherein the front panel 14 is in an open position, revealing a toilet paper dispenser 20. The toilet paper dispenser 20 essentially includes a bar 22, which holds a standard toilet paper roll 24. The standard toilet paper roll 24 as shown includes a continuous length of toilet paper 25, arranged in sheets 26, separated by perforations 27. When the front panel 14 is open, the toilet paper can be unrolled from the roll 24, and torn off at the perforations 27 as needed.

FIG. 2 illustrates an inner housing 30, located within the main housing 12 adjacent to the top 12T. The inner housing 30 has an inner housing front 30F, which is substantially covered and concealed when the front panel 14 is in the closed position.

A clock 40 is mounted in the inner housing 30, having a clock face 42 on the inner housing front 30F. A radio 50 is mounted in the inner housing 30, having radio controls 52 on the inner housing front 30F.

A flashlight 60 has a flashlight housing 62, a lens 64, and a switch 65. The inner housing 30 has a flashlight recess 35 extending into the inner housing front 30F for accommodating the flashlight 60. A pair of clips 36 in the flashlight recess 35 allow the flashlight to be detachably mounted in said recess 35. The main housing has a beam aperture 28 in the side 12S. When the flashlight is mounted in the flashlight recess 35, the lens 64 is directed at the beam aperture 28, and the switch 65 is nearly flush with the inner housing front 30F. However, the flashlight is fully detachable from the main housing 12 at the clips 36, and is thereby capable of fully independent operation therefrom.

Now, back to FIG. 1, with the front panel 14 in the closed position, the clock face 42 is visible through a clock opening 44 in the front panel 14. The radio controls 52 are operable through radio control openings 46 in the front panel 14. In addition, the flashlight switch 65 is operable through a flashlight switch opening 69 in the front panel 14. When the flashlight 60 is operated, light from the lens 64 is directed through the beam aperture 28, which illuminates the vicinity external to the main housing 12.

Figure 3:
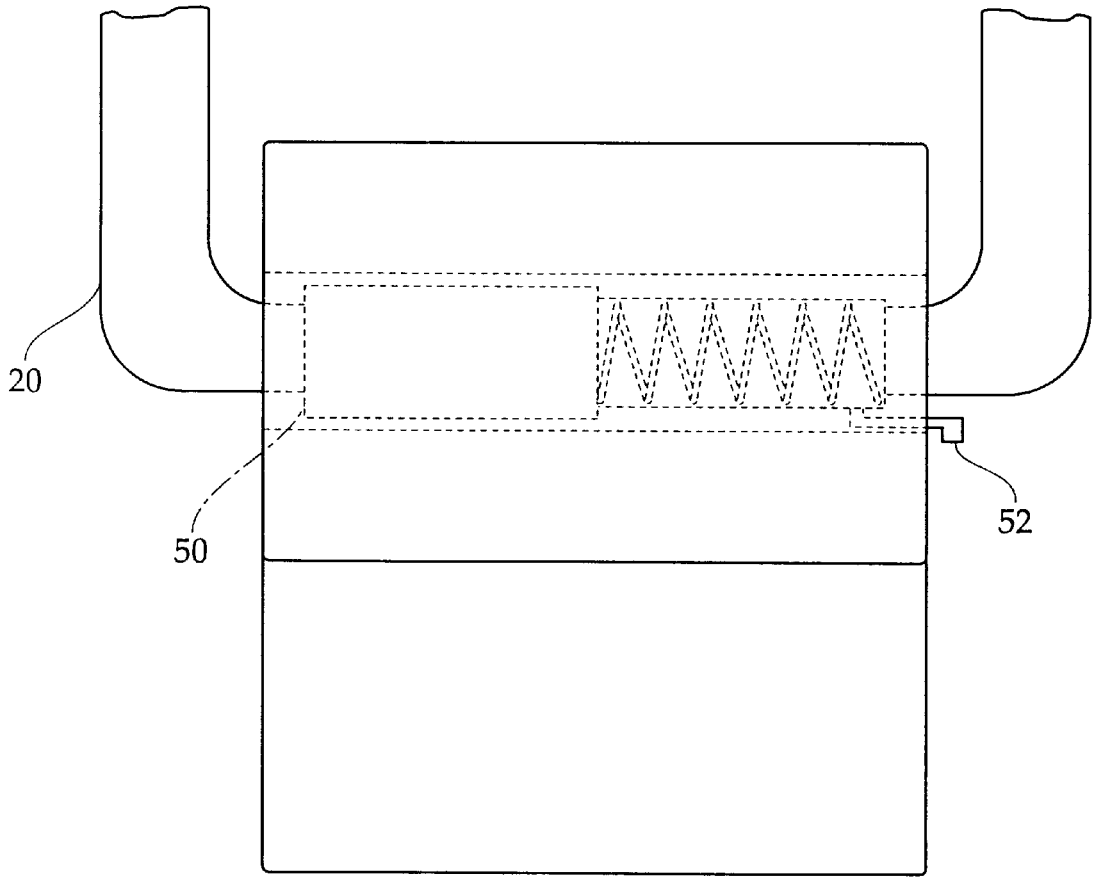
FIG. 3 is a side elevational view, schematically illustrating an internal mechanism with the toilet paper dispenser which limits the toilet paper dispensing.

FIG. 3 illustrates just the toilet paper dispenser 20, and schematically illustrates a limiting mechanism 50. The purpose of the limiting mechanism is to limit the amount of toilet paper 25 obtained by a user. Preferably, the amount of toilet paper is limited to one or two sheets 26. Thus, inadvertent unraveling of the toilet paper 25 is prevented. The precise mechanism of the limiting mechanism is beyond the scope of the present discussion, because the design and construction of such mechanisms are well known in the general art of rolled product dispensers, although incorporation of such a mechanism into a portable dispenser is not. General design constraints for such a limiting mechanism suitable for the purposes of the present invention, however, would describe a mechanism which either allows the roll to undergo a fixed rotation with each pull and then lock to prevent further rotation, or allows the roll to undergo a fixed rotation each time a locking release tab 52 is pressed. The amount of the fixed rotation would be calibrated so that substantially one or two sheets is unraveled with each rotation cycle.

In conclusion, herein is presented a toilet paper caddy which allows a user to conveniently and sanitarily store, transport, and dispense toilet paper, while providing several other safety, survival, and convenience features.

What is claimed is:

1. A toilet paper caddy, for storing, transporting, and dispensing toilet paper from standard toilet paper rolls having a continuous length of toilet paper divided into sheets which are separated by perforations, comprising:

a main housing having a top, a bottom, and a front panel hingeably attached to the bottom;

an inner housing, located inside the main housing, the inner housing having an inner housing front which is covered when the front panel is closed, and is revealed when the front panel is opened, said inner housing further having a flashlight recess;

a flashlight, detachably mounted within the flashlight recess, having a flashlight switch and a flashlight lens, wherein the main housing has a beam aperture, wherein the flashlight switch extends nearly flush with the inner housing front and the lens is directed at the beam aperture when the flashlight is mounted in the flashlight recess, and wherein the front panel has a flashlight switch opening which allows the flashlight to be operated when the front panel is closed wherein light from the flashlight lens is directed through the beam aperture;

a toilet paper dispenser having a bar upon which the toilet paper roll is mounted;

a handle mounted to the top; and wherein the front panel is selectively in an open position wherein access is provided to the toilet paper roll, and a closed position wherein the toilet paper roll is covered and concealed.

2. The toilet paper caddy as recited in claim 1, further comprising a clock having a clock face, the clock face located in the inner housing front, wherein the front panel has a clock face opening so that the clock face can be viewed through the front panel when the front panel is in the closed position.

3. The toilet paper caddy as recited in claim 2, further comprising a radio having radio controls, the radio controls located in the inner housing front, wherein the front panel has radio control openings so that the radio controls can be operated through the front panel when the front panel is in the closed position.

* * * * *